United States Patent [19]

Manabe

[11] Patent Number: 4,537,462

[45] Date of Patent: Aug. 27, 1985

[54] ELECTRICAL CONNECTOR

[75] Inventor: Sakae Manabe, Kawasaki, Japan

[73] Assignee: AMP Incorporated, Harrisburg, Pa.

[21] Appl. No.: 636,033

[22] Filed: Jul. 30, 1984

[30] Foreign Application Priority Data

Sep. 9, 1983 [JP] Japan ..... 58-139213

[51] Int. Cl.[3] ..... H01R 13/16

[52] U.S. Cl. ..... 339/259 R

[58] Field of Search ..... 339/259, 262

[56] References Cited

U.S. PATENT DOCUMENTS 1,589,066 6/1926 Gibbons .
2,704,838 3/1955 Macha et al. .
3,836,947 9/1974 Yeager .
3,914,008 10/1975 Hollander et al. ..... 339/259 R

FOREIGN PATENT DOCUMENTS 1427747 4/1966 France .
336612 10/1930 United Kingdom ..... 339/259 R

OTHER PUBLICATIONS

AMP Catalog 73-204 revised 6-83, p. 35, "CPC (Circular Plastic) and Metal-Shell CPC Connectors" (AMP Incorporated).

*Primary Examiner*—Joseph H. McGlynn
*Attorney, Agent, or Firm*—Anton P. Ness

[57] ABSTRACT

An assist spring is provided for a female terminal having contact arms in a high conductivity electrical connector. The assist spring may be formed of high resilient material and have dual support to assist the lower resilience, more conductive material of the contact arms and provide greater contact force on a male terminal inserted into the female terminal.

9 Claims, 9 Drawing Figures

ELECTRICAL CONNECTOR

FIELD OF THE INVENTION

This invention relates to an electrical connector, and more particularly to an electrical connector having an assist spring.

BACKGROUND OF THE INVENTION

Generally the selection of materials for electrical terminals depends upon the sort of connectors in which the terminals are used and the type of electrical equipment onto which the connectors are applied. For instance, copper terminals having very high electrical conductivity are used for power-connecting connectors which are required to have low electrical loss and little temperature increase.

However, copper terminals have a disadvantage in that one mechanical property especially, relatively low resilience, is inferior because of the low limit of elasticity of copper; although the electrical properties of copper are excellent compared to terminals of other materials. Therefore, in the use of a copper terminal where high resiliency is required, for example a female terminal of copper which is required to engage a male terminal and maintain a steady contact pressure even after repetitive insertion of the male terminal, it has recently become the practice to use leaf springs punched out from highly resilient sheet metal to be put upon the electrical terminal as back-up members which help to maintain the contact pressure.

SUMMARY OF THE INVENTION

According to the present invention, a spring assist means is provided for a female terminal, to be placed in an insulating housing of an electrical connector. For a female terminal having a pair of opposing contact arms being bent first inwardly towards each other at their base then outwardly from each other, forming contact portions to receive a male terminal insertable therein, a pair of leaf springs extend from a base or bridge portion of the assist spring which is secured to the base of the contact arms, the leaf springs extending in a cantilever manner along and close to the outside surfaces of associated contact arms and then outwardly away from each other ending in free ends. When a male terminal is first inserted between the contact arms, the contact arms engage the leaf springs urging them outward toward sidewalls of the housing. As the male terminal continues to be inserted, the free ends of the leaf springs initially engage their associated sidewalls and then slide therealong. During this time, the leaf springs are thus supported at both ends, and the leaf springs urge the contact arms against the male terminal, providing high contact force. The spring assist means is of a material having high resilience as opposed to relatively much lower resilience of the material of the terminal contact arms, and thus adds stiffness to significantly increase the contact force of the contact arms against the contact portions of the male terminal inserted therebetween.

DESCRIPTION OF THE PRIOR ART

Figure 1:
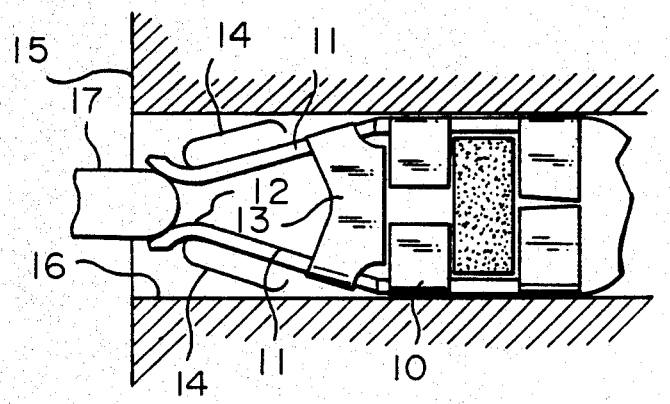
FIG. 1 PRIOR ART
FIG. 1 is a part longitudinal sectional view of an electrical connector of the prior art.

FIG. 1 illustrates an electrical connector of the prior art. The electrical connector comprises an electrical terminal which is provided with a pair of opposing contact arms 11 and a pair of leaf springs 14 interconnected with each other by a bridge 13 and attached to the outside of the base of the contact arms 11, and an insulating housing 15 which is provided with a contact cavity 16 to contain the electrical terminal. The pair of contact arms 11 are bent at their base in the direction to approach each other and reach the closest point near their free ends to form the contact portions 12; the free ends bend slightly outwardly to receive a male terminal therebetween. The leaf springs 14 extend from base or bridge 13 along the outside surfaces of contact arms 11 in a cantilever manner and are folded outwardly proximate the contact portions 12 and then backwardly. The free end of each spring 14 at its very end is bent inwardly leaving a clearance between itself and the housing wall. When a male terminal 17 having a thickness larger than the gap between the contact portions 12 of the contact arms 11 is inserted into the gap, the contact arms are displaced to be away from each other and make the free ends of leaf springs 14 butt against the housing walls. Consequently each of the leaf springs 14 forms a cantilever spring of "U" shape which has a force-applying point at its folded portion, and supporting points at its free end abutting against the housing wall and at the base or bridge portion 13 attached to the base of the contact arms. Thus, the folded portion acts to push against the outside surface of the contact portion 12 of contact arm 11 to supplement the resilience of the contact plate. However, in this known electrical connector, the above-mentioned cantilever construction of the leaf spring provides only a weak pushing force upon the contact portion, leading to the problem that the insufficient contact pressure arising therefrom causes improper electrical contact between the male and female terminals.

DETAILED DESCRIPTION OF THE PREFERRED EMBODIMENT

The present invention was made in consideration of the problem mentioned above, and has the objective to provide an electrical connector which contains back-up springs to increase the contact pressure of electrical terminals having low resilience. Now an example of the invention will be described with reference to the accompanying drawings.

Figure 2:
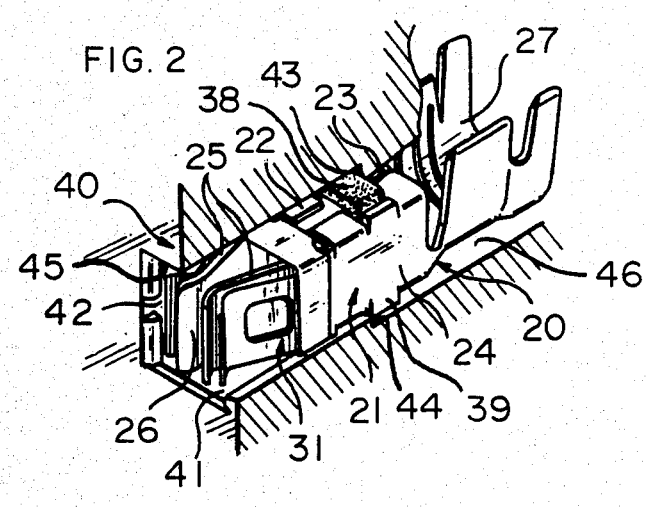
FIG. 2 is a partially cut-out perspective view of an electrical connector according to the invention.

FIG. 2 shows an electrical connector according to the invention, the connector comprising an electrical terminal 20 which is formed by bending a punched-out copper sheet, and an insulating housing 40 which has a contact cavity 41 to contain the terminal. Electrical terminal 20 has a central terminal body 21 which is formed in a box shape with an abutting longitudinal seam 23 on its upper wall, and a pair of contact arms 25 extending at one end of body 21 from the opposing walls 24 thereof. Contact arms 25 are bent inwardly at the base to approach each other, reach the closest points near their free ends to form contact portions 26, and are bent outwardly at the points past the contact portions to define an inlet for a male terminal. Terminal body 21 also is provided with a conductor-receiving portion 27 on the end opposite to contact strips 25, the conductor-receiving portion 27 being integrally formed with the bottom wall of terminal body 21 to receive a conductor wire (not shown) to be crimped therein.

Figure 3:
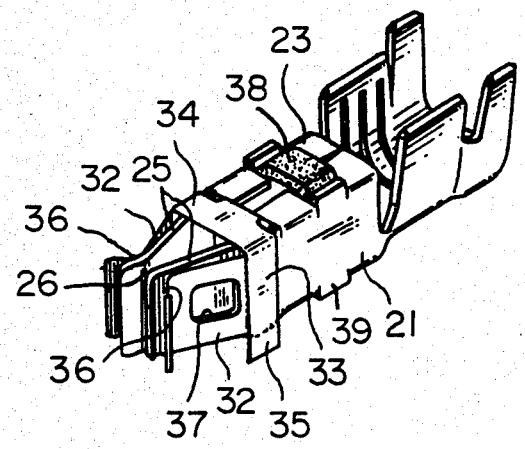
FIG. 3 is a perspective view of the electrical terminal shown in FIG. 2.

Each of the terminals 20 is further provided with an assist spring 31 made of highly resilient sheet metal, for instance, stainless steel punched out and formed by bending. Assist sprng 31 consists of a pair of leaf springs 32 extending along the outside surface of contact arms 25. Leaf springs 32 are interconnected with each other by a spring body portion or bridge 34 which extends between base portions 33 thereof and are attached to the terminal, as seen in FIG. 3, by an engaging end 35 being folded over the inside of the contact arm, the engaging end 35 extending from the other side of base portion 33 from bridge 34. Bridge 34 is positioned on the upper wall side of the body 21 where the abutting seam of the body 21 is located, thereby preventing the opposing side walls 24 of the body from being deformed outwardly to open abutting seam 23 and keeping the opposing contact arms 25 at a constant distance, when the male terminal is being inserted.

The leaf springs 32 are bent inwardly at the base portion 33 to close towards each other and reach the closest point at 36 proximate the bent contact portion 26 of contact arm 25, from which point the springs are being outwardly away from each other having arcuate free ends, each free end of the springs being terminated at a point slightly inward of the surface of side wall 24 of body 21. In the Figures, the central bent portion 36 of each spring 32 is engageable at an engagement point with the outside surface of contact portion 26 of each contact arm 25. However, this condition is not always necessary, and a clearance is allowable between the central bent portion 26 and the contact portion 26.

Each leaf spring 32 has an aperture 37 between bent portion 36 and base portion 33, aperture 37 serving to disperse stress produced in the leaf spring while a male terminal is inserted between contact arms 25, thus preventing stress concentration onto the central bent portion 36 of the springs.

A contact cavity 41 of an insulating housing 40 is defined, as shown in the part section of FIG. 2, by a pair of side walls 42 extending parallel to side walls 24 of terminal 20 and top and bottom walls 45, 46 which respectively have steps 43, 44. Step 43 of top wall 45 is engaged by the rear edge of an elastic member 38 which is embedded in body 21 of terminal 20, to limit the rearward movement of the terminal. Step 46 of bottom wall is engaged by the forward edges of a pair of projections 39 which extend from the bottom wall of body 21 to limit the forward movement of the terminal.

Figure 4A:
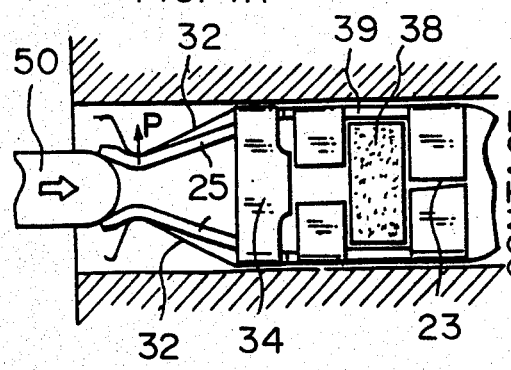
FIGS. 4A, 5A and 6A are part longitudinal sectional views showing the process of fitting a male terminal into the electrical connector according to the invention.
Figure 4B:
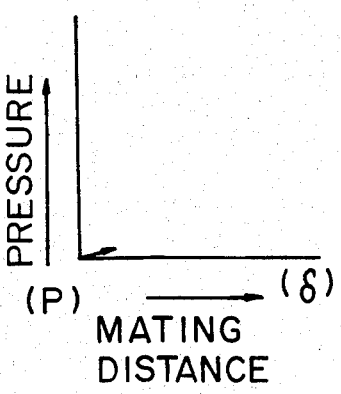
FIGS. 4B, 5B and 6B graphically show the contact pressures P between the male and female terminals respectively of FIGS. 4A, 5A and 6A.

The action of leaf springs 32 will be described below with reference to FIGS. 4A, 5A and 6A. FIG. 4A shows a male terminal 50 which is in an initial engaging position with contact arms 25, where the male terminal is slightly pushed against the inlet formed by the contact arms, and contact arms 25 and leaf springs 32 are slightly displaced apart respectively. FIG. 4B shows the contact pressure P occurring between male terminal 50 and contact arms 25. Contact pressure P corresponds to the reaction of the contact arms and the leaf springs produced by the insertion of the male terminal, and it increases in proportion to the mating distance. The contact pressure P at this position is small because the contact arms 25 and leaf springs 32 are of cantilever construction.

Figure 5A:
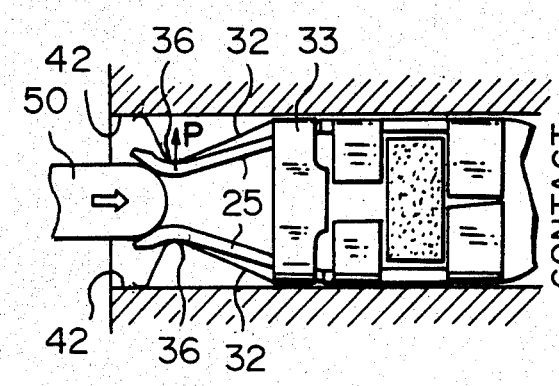
Figure 5B:
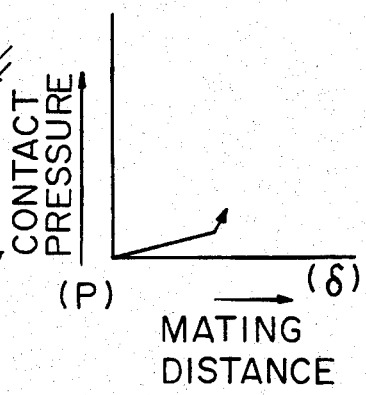

FIG. 5A shows the position where male terminal 50 is inserted farther than the position in FIG. 4A, and each of contact arms 25 pushes the central bent portion 36 of each leaf spring 32 so as to butt the free end thereof again an associated side wall 42 of housing 40. Since both ends of each leaf spring 32 are supported, at base portion 33 and side walls 42 in this condition, the reaction produced in the central bent portion 36 is larger, and therefore the contact pressure is increased abruptly (FIG. 5B). As the male terminal 50 is farther inserted after the free ends of leaf springs 32 have abutted against the sidewalls, each leaf spring 32 is deformed with its central bent portion compressed and the free end thereof slidingly displaces along the surface of its associated side wall 42.

Figure 6A:
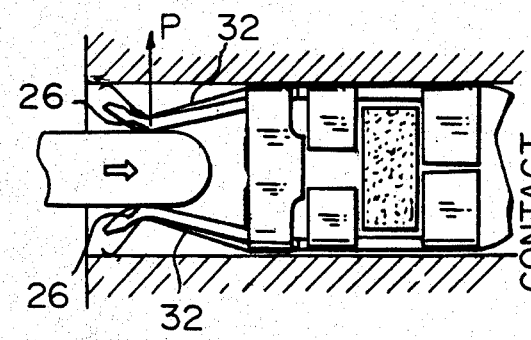
Figure 6B:
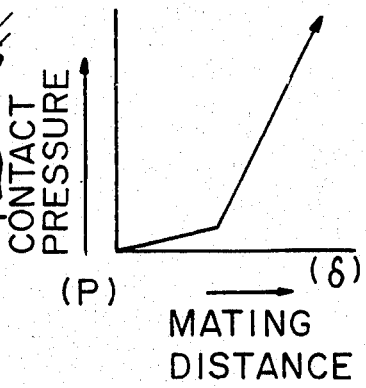

FIG. 6A shows the position where the male terminal 50 has been fully inserted into the contact portions 26 of contact arms 25, where the free ends of leaf springs 32 have moved from their initial engaging positions to the farthest positions thereof along associated sidewalls 42, and during this period each leaf spring 32 forms a spring supported at both ends therefore keeping high contact pressure, as illustrated in FIG. 6B. When the male terminal is pulled out, the contact arms are urged to return to their initial condition (FIG. 4A) by the action of leaf springs 32.

While the above description of the subject invention is of a preferred embodiment, other embodiments which will be apparent to one skilled in the art, and which utilize teachings set forth, are intended to be within the spirit of the subject invention.

I claim:

1. A spring assist means for a female electrical contact terminal, said female terminal having opposing contact arms to receive therebetween contact portions of a male terminal and being secured within a cavity of an insulating housing, said spring assist means comprising a spring body portion and leaf spring portions, said spring body portion securable to a body portion of said female terminal remote from contact portions of said contact arms, said leaf spring portions extending from said spring body portion along and proximate outer surfaces of said contact arms and including free ends engageable with and slidable along associated side walls of said housing cavity, whereby when a said male terminal is inserted into and between said contact arms, said contact arms are urged into engagement with said leaf springs whose free ends are urged into slidable engagement with said cavity side walls and thereby provide spring force against said contact arms increasing contact force of said contact arms with contact portions of said male terminal.

2. A spring assist means as set forth in claim 1 wherein said spring assist means is made of resilient material.

3. A spring assist means as set forth in claim 1 wherein said spring assist means is stamped and formed of stainless steel.

4. A spring assist means as set forth in claim 1 wherein said free ends of said leaf springs are normally spaced from said side walls when said male terminal is removed from said female terminal.

5. A spring assist means as set forth in claim 1 wherein an aperture is placed in each said leaf spring between said spring body portion and that point at which said leaf spring engages an associated contact arm to prevent stress concentration proximate said engagement point.

6. A spring assist means as set forth in claim 1 wherein said spring body portion extends substantially around said female terminal.

7. A spring assist means as set forth in claim 6 wherein said female terminal has a longitudinal seam and said spring body portion extends across said seam and tightly engages said female terminal holding said seam together.

8. A spring assist means as set forth in claim 1 wherein said contact arms of said female terminal first extend inward from said terminal body portion toward each other to a contact portion, then outward forming an inlet for a said male terminal, said leaf springs extending substantially parallel to said contact arms to an engagement point and then extend therefrom outward towards said cavity side walls to said free ends.

9. A spring assist means as set forth in claim 8 wherein said leaf springs normally engage said contact arms at said engagement point when said male terminal is removed from said female terminal.

* * * * *